US006315286B1

(12) United States Patent
Muenchinger et al.

(10) Patent No.: US 6,315,286 B1
(45) Date of Patent: Nov. 13, 2001

(54) JOGGER SYSTEM FOR A MIXED MAIL CANCELLATION FEEDER

(75) Inventors: Mark F. Muenchinger, San Francisco, CA (US); James A. Salomon, Cheshire; Anthony E. Yap, Danbury, both of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/456,187

(22) Filed: Dec. 7, 1999

(51) Int. Cl.[7] ..... B65H 3/62
(52) U.S. Cl. ..... 271/146
(58) Field of Search ..... 271/146, 210, 271/248; 209/900; 193/8; 198/521, 594, 609, 752

(56) References Cited

U.S. PATENT DOCUMENTS

| | | | | |
|---|---|---|---|---|
| 3,598,399 | * | 8/1971 | Gordon | 271/62 X |
| 3,966,193 | * | 6/1976 | Storace et al. | 271/150 X |
| 4,275,875 | | 6/1981 | Akers | 271/5 |
| 4,371,155 | * | 2/1983 | Astero et al. | 270/53 X |
| 4,757,985 | | 7/1988 | Hamant et al. | 271/31.1 |
| 4,789,148 | * | 12/1988 | Noguchi et al. | 271/94 X |
| 5,290,022 | | 3/1994 | Sabatier et al. | 271/12 |
| 5,374,050 | | 12/1994 | Prim | 271/221 |
| 5,413,323 | | 5/1995 | Imbert et al. | 271/149 |
| 5,915,685 | * | 6/1999 | Bausch et al. | 271/157 X |

* cited by examiner

*Primary Examiner*—Christopher P. Ellis
*Assistant Examiner*—Kenneth W. Bower
(74) *Attorney, Agent, or Firm*—Alberta A. Vitale; Steven J. Shapiro; Michael E. Melton

(57) ABSTRACT

A jogger system to be mounted on a vertical stack mixed mail feeder to provide a vibration, intermittently pushing a mail stack preferably on the outboard side of the mail stack in order to cause the bottom edges of the mail stack to rest on an outboard slider bed and a timing belt on the feeder, and to align the lead-edges of the mail stack against a registration wall. Preferably, the jogger system is integrated to the outboard slider bed of the feeder and comprises at least one imbalance weight rotatably mounted on a shaft which is substantially parallel to the length of the slider bed, and a motor to rotate the imbalance weight so as to cause the vibration. The jogger system further comprises compliance means to be placed between the jogger system and the feeder for mounting.

19 Claims, 6 Drawing Sheets

JOGGER SYSTEM FOR A MIXED MAIL CANCELLATION FEEDER

TECHNICAL FIELD

The present invention relates generally to a mixed mail cancellation system or a mixed mail sorter, and, more specifically, to a vertical stack mixed mail feeder, including a jogger system for automatically registering mixed mail on the feeder.

BACKGROUND OF THE INVENTION

In a mixed mail transport system, a vertical stack mixed mail feeder, or stack advance, is used to support and advance the mail stack to a nudger. The nudger typically moves the individual mailpieces from the mail stack in a shingled manner toward a mail separator which separates individual pieces of mail for subsequent processing such as being canceled by a print head. A typical stack advance is shown in FIG. 1. In the stack advance 10, mailpieces 12 are loaded in a stack 14 upside down on a long deck 16, with the face 18 of the mailpieces facing the nudger (not shown), which is located near the downstream end 200 of the stack advance 10. The upstream end of the stack advance 10 is denoted by reference numeral 202. Perpendicular to the deck 16, a vertical registration wall 20 is used to register the mailpieces 12. In proper registration, the leading edge 22 of every mailpiece 12 in the stack is aligned against the registration wall 20. The bottom edges 24 of the mailpieces 12 are supported by a transport timing belt 30 and an outboard slider bed 34. An inboard slider bed, which is not shown in the figure, is located below the timing belt 30 for supporting the timing belt 30. The outboard slider bed 34 is provided on the trailing edge side 26 of the mailpieces 12 to allow the mailpieces 12 to slide toward the nudger along a direction indicated by an arrow 204. The timing belt 30, driven by a motor (not shown), is used to drive the mail stack 14 toward the nudger. The downstream side of the mail stack 14 is supported by a paddle 40. The bottom 42 of the paddle 44 has a paddle tooth (not shown) attached thereto for riding in the grooves 32 of the timing belt 30 for advancing the paddle 40 toward the downstream end 200 along with the mail stack 14. It should be noted that FIG. 1 shows only a few mailpieces 12 in a mail stack 14 being stacked on the stack advance 10. Typically, a mail stack fills the gap between the paddle 40 and the nudger. At the nudger, the leading edge 22 of each mailpiece 12 is ingested into the nudger along a direction indicated by an arrow 206. The mailpieces 12 from the stack 14 are separated by the nudger for further processing such as being canceled by a printhead (not shown).

Testing with vertical stack mixed mail feeders has shown that when mail is poorly registered onto the stack advance deck, the performance of the system, in terms of jams, stalls and multifeeds, degrades significantly. Furthermore, the quality of loading plays a great role in the performance of the vertical stack mixed mail feeders. When mail is poorly bottom registered, mail has a tendency to miss some or all of the driving and/or retard elements in the feeder. This will cause jams, stalls and multifeeds. When mail is poorly lead-edge registered, gross reverse shingling can occur, which greatly increases the likelihood of multifeeds. Therefore, to allow the machine to perform as well as possible, the mail must be bottom and lead-edge registered. Registering the mail manually is time-consuming, especially when the mail mix is severe. In an actual environment, it is impractical to rely on the operator to perform this difficult and time-consuming task.

It is, therefore, desirable to provide a method and device to improve the mail registration in a mixed mail feeder.

SUMMARY OF THE INVENTION

The method to improve mailpiece registration in a vertical stack mixed mail feeder, according to the present invention, uses a jogger system to intermittently or periodically push the mail stack up and down in a vibration-like motion at the outboard side while the mailpieces are being transported downstream. Preferably the jogger system is integrated with the outboard slider bed to provide a vibration-like motion. The vibration is intended to loosen each mailpiece from its two adjacent mailpieces, thereby allowing the mailpiece to rest on the outboard slider bed and move toward the registration wall.

In the preferred embodiment, the jogger system is attached to the bottom of the outboard slider bed. A motor and at least one eccentric weight mounted on a motor shaft are installed on the underside of the slider bed. A compliance means such as low durometer grommets are placed between the jogger system and the stack mail feeder for mounting. The compliance means allows the slider bed to move in a vibration mode.

The method and device for improving mailpiece registration in a stack mail feeder will become apparent upon reading the description taken in conjunction with FIG. 2 to FIG. 6.

DETAILED DESCRIPTION

Figure 1:
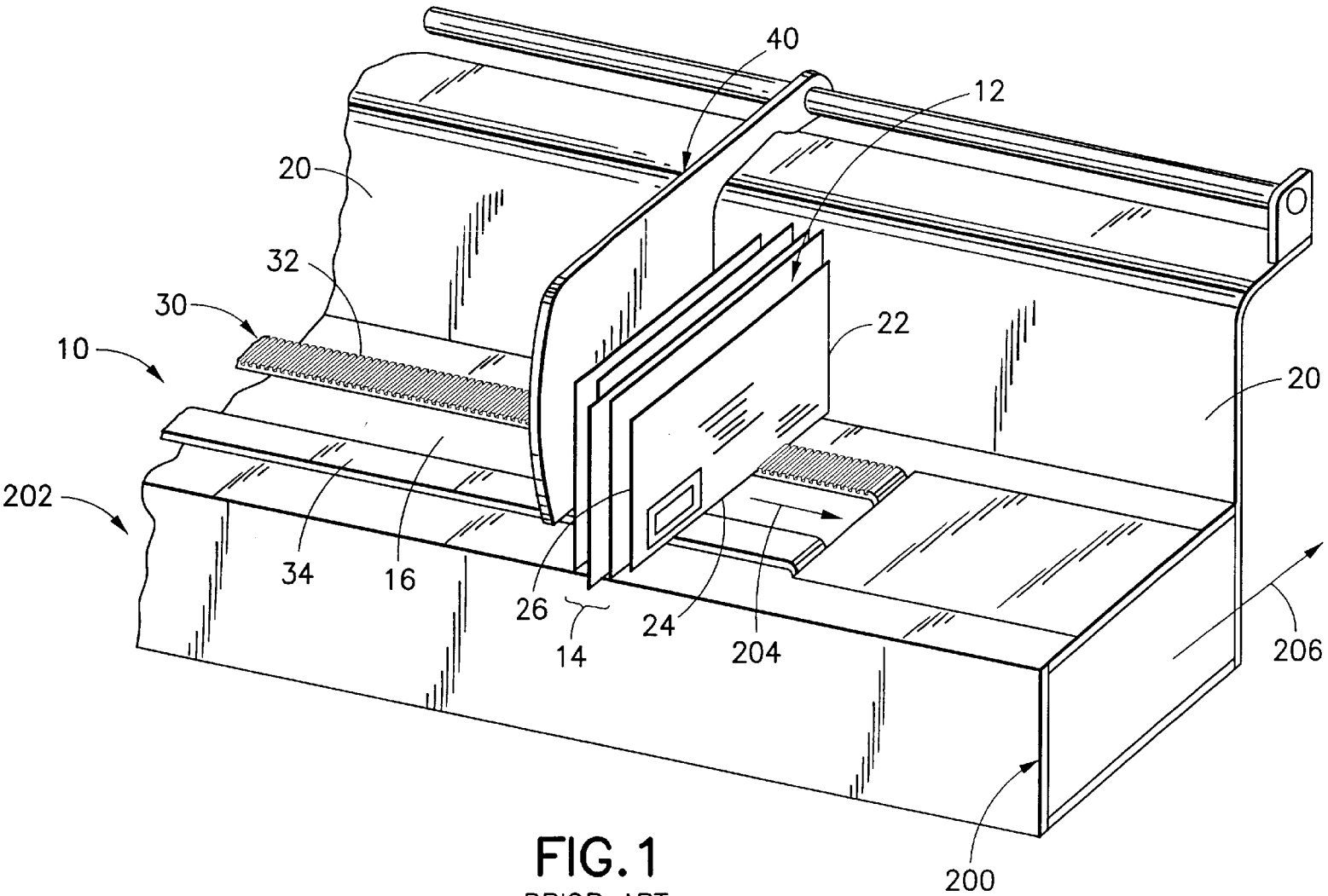
FIG. 1 PRIOR ART
FIG. 1 is an isometric view of a prior art stack advance.
Figure 2:
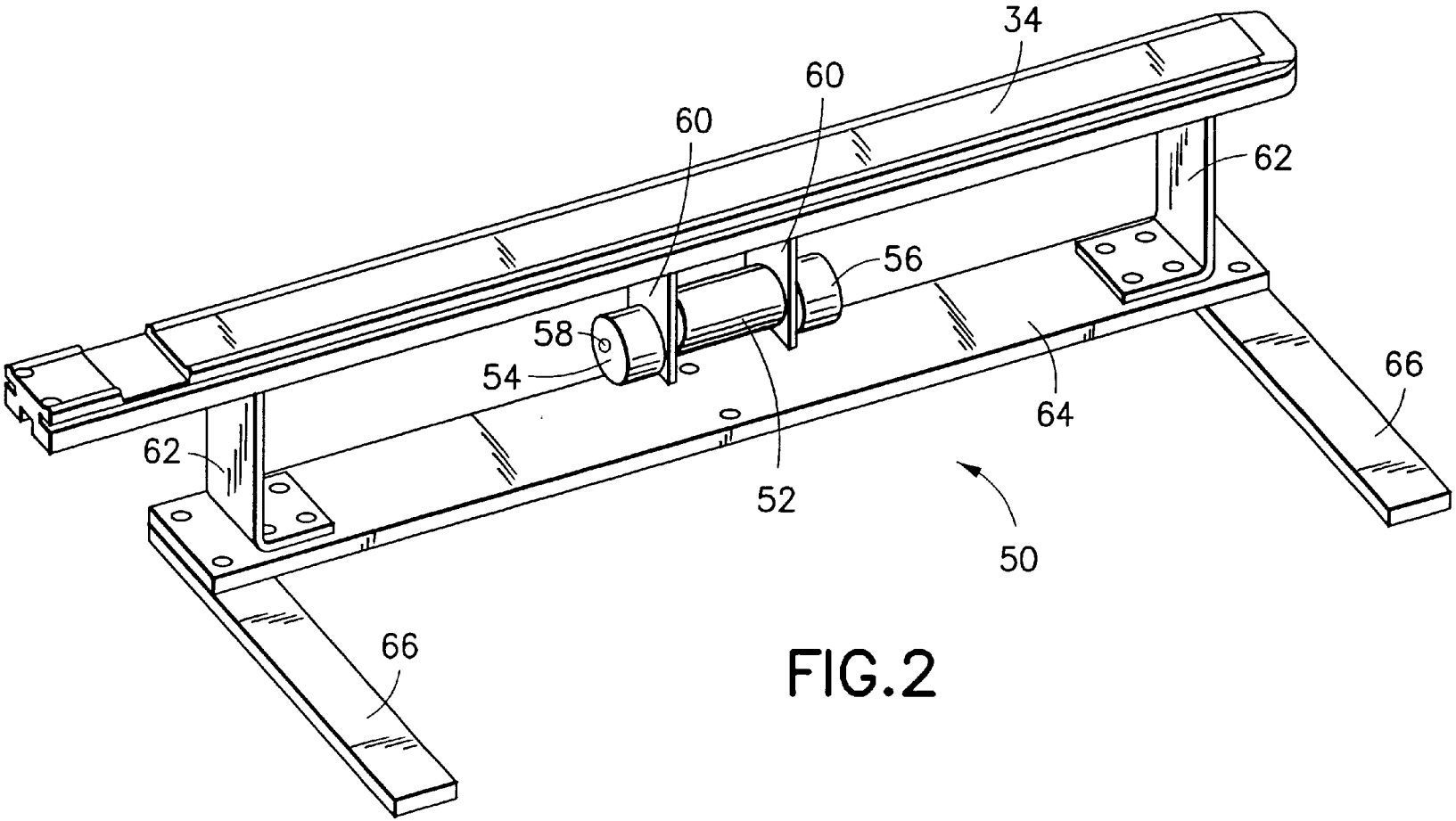
FIG. 2 is an isometric view of the mail jogging system, according to the present invention, which is integrated to the outboard slider bed of the stack advance.

As shown in FIG. 2, the jogger system 50 is attached to the bottom of the outboard slider bed 34. A motor 52 with eccentric weights 54, 56 mounted, respectively, to each end of a motor shaft 58 is attached to the underside of the slider bed 34 using a motor mount 60. A mounting bracket 62 is used to attach the slider bed 34 to a jogger base plate 64.

Figure 3:
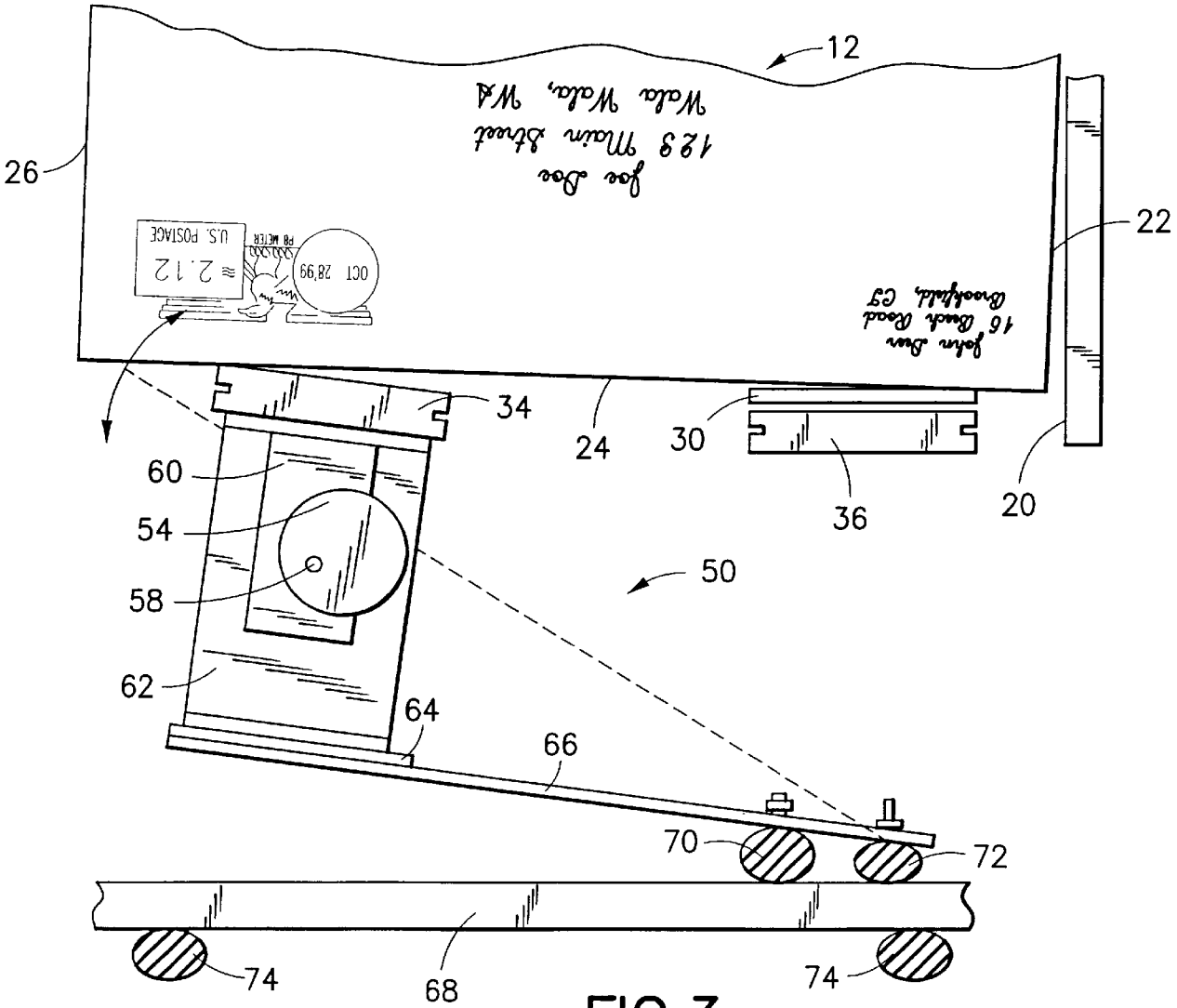
FIG. 3 is an end view of the mail jogging system, showing how the jogging system is mounted on the stack advance in the preferred embodiment of the present invention.

As shown in FIG. 3, in the preferred embodiment of the present invention, the entire jogger system 50 is attached, preferably, to two arm brackets 66. The arm brackets 66 are mounted to a baseplate 68 of a stack advance. Grommets 70, 72 are both placed between each of the arm brackets 66 and the baseplate 68 to act as a spring and a hinge, respectively. Preferably, the inboard end grommet 72 is made of high durometer material and the outboard end grommet 70 is made of low durometer material. By locating grommets 70, 72 in this manner, horizontal and vertical vibration components are achieved since the imbalance created by the rotating eccentrically mounted weights 54, 56 tends to pivot about the hinge point at grommets 72. The vertical component of the vibration, with the help of gravity, tends to register the bottom edge 24 of the mailpiece 12 down to the outboard slider bed 34 and the timing belt 30, which is supported by an inboard slider bed 36. As the outboard slider bed 34 moves upwards in its vibration cycle, the mounting of the jogger system 50 on the arm brackets 66 also causes the slider bed 34 to move inwards toward the registration wall 20 on the stack advance. This horizontal component of vibration tends to move the mailpieces 12 towards the registration wall 20 and helps align the leading edge 22 of the mailpieces 12 against the registration wall 20. It has been found that a good operating range for the jogging system 50 is between 1900 and 2800 rpm in vibration frequency, and about 0.5–2.5 mm in amplitude, for example.

It should be noted that while grommets 70, 72 are shown in FIG. 3, any type of flexure could be used for springs and hinges. Also, the grommets 70 and 72 may be of the same durometer material. Furthermore, it is preferred that other grommets 74 or damping materials be mounted under the baseplate 68 to isolate the vibration caused by the jogger system 50 from other parts of the stack advance.

It is also preferable to have a separate, intermittent switch (not shown) to control the motor so as to allow the operator to activate or deactivate the jogging system 50 when needed.

Figure 4A:
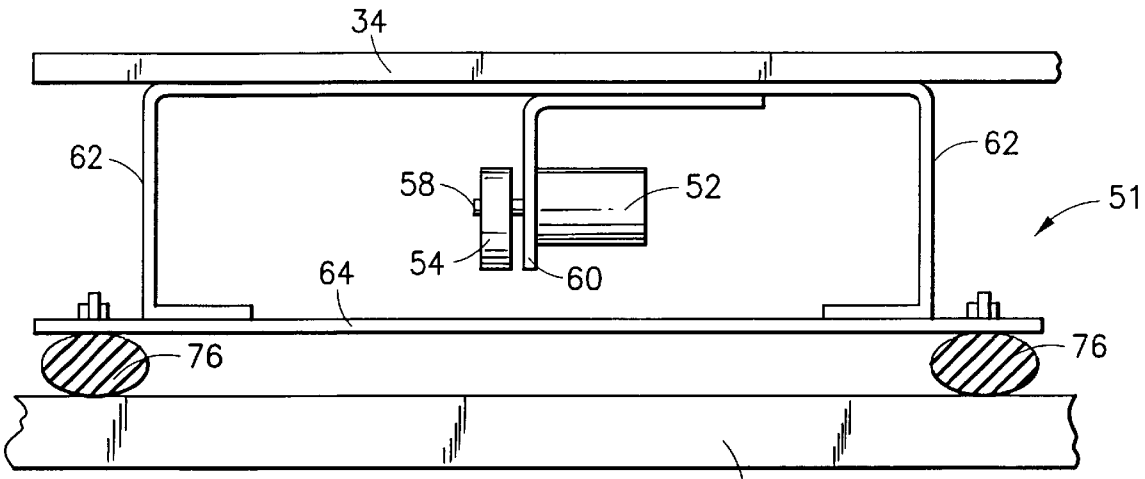
FIGS. 4A and 4B illustrate another embodiment of the jogging system.
Figure 4B:
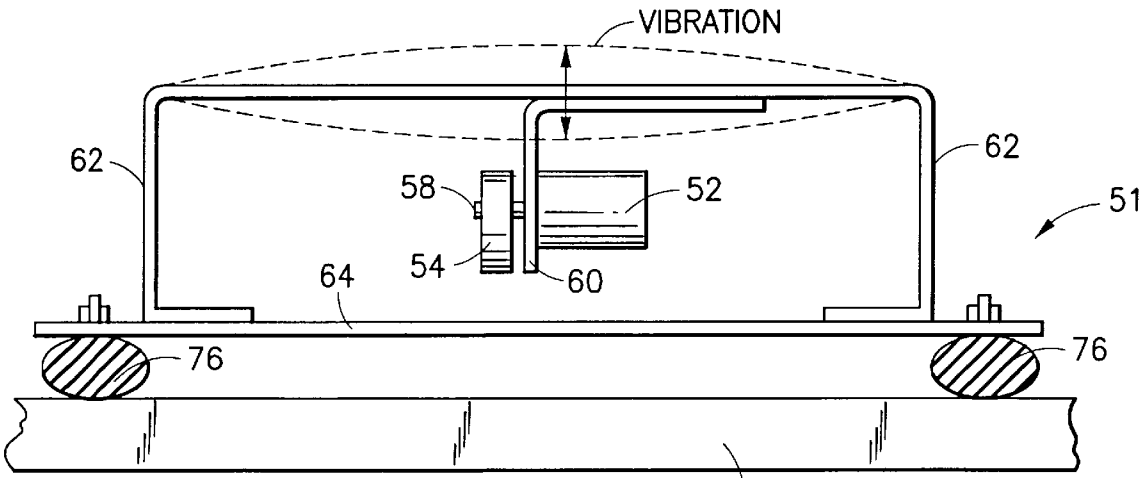

FIG. 4A illustrates another mounting method for the mail jogger system. As shown, the entire jogging system 51 is mounted directly on the baseplate 68 of the stack advance, without arm brackets. A plurality of grommets 76, preferably of low durometer material, are placed between the jogger base plate 64 and the stack advance base plate 68. The grommets 76 act as dampers to isolate the jogger system 51 from the baseplate 68 and allow the slider bed 34 to vibrate along with the support bracket 62, as shown in FIG. 4B. The grommets 76 prevent the vibration form transmitting to the machine through the baseplate 68. The vibration may have an adverse effect on the printing subsystem of the mail cancellation system.

It should be noted that in FIG. 2, two eccentrically mounted weights 54 and 56 are used to cause the vibration of the jogger system 50. It is possible to use only one eccentrically mounted weight 54 to cause the vibration, as shown in FIG. 4A. The jogger systems 50 and 51, as illustrated in FIGS. 2–4A, each is integrated to the outboard slider bed 34 by attaching the rotating weights 54, 56 to the bottom of the outboard slider bed 34. It is possible to use cams or other devices to cause the outboard slider bed 34 to vibrate.

In addition, the inboard slider bed 36 which supports the timing belt 30 (FIG. 3) can also incorporate the jogger systems 50, 51 described herein. In this configuration both the timing belt 30 and the outboard slider bed 34 would vibrate and work together for proper lead edge and bottom edge alignment. In this embodiment, the tooth on the bottom edge 42 of the paddle 40 would have to be a compliance tooth so that the paddle would be isolated from vibration.

Figure 5:
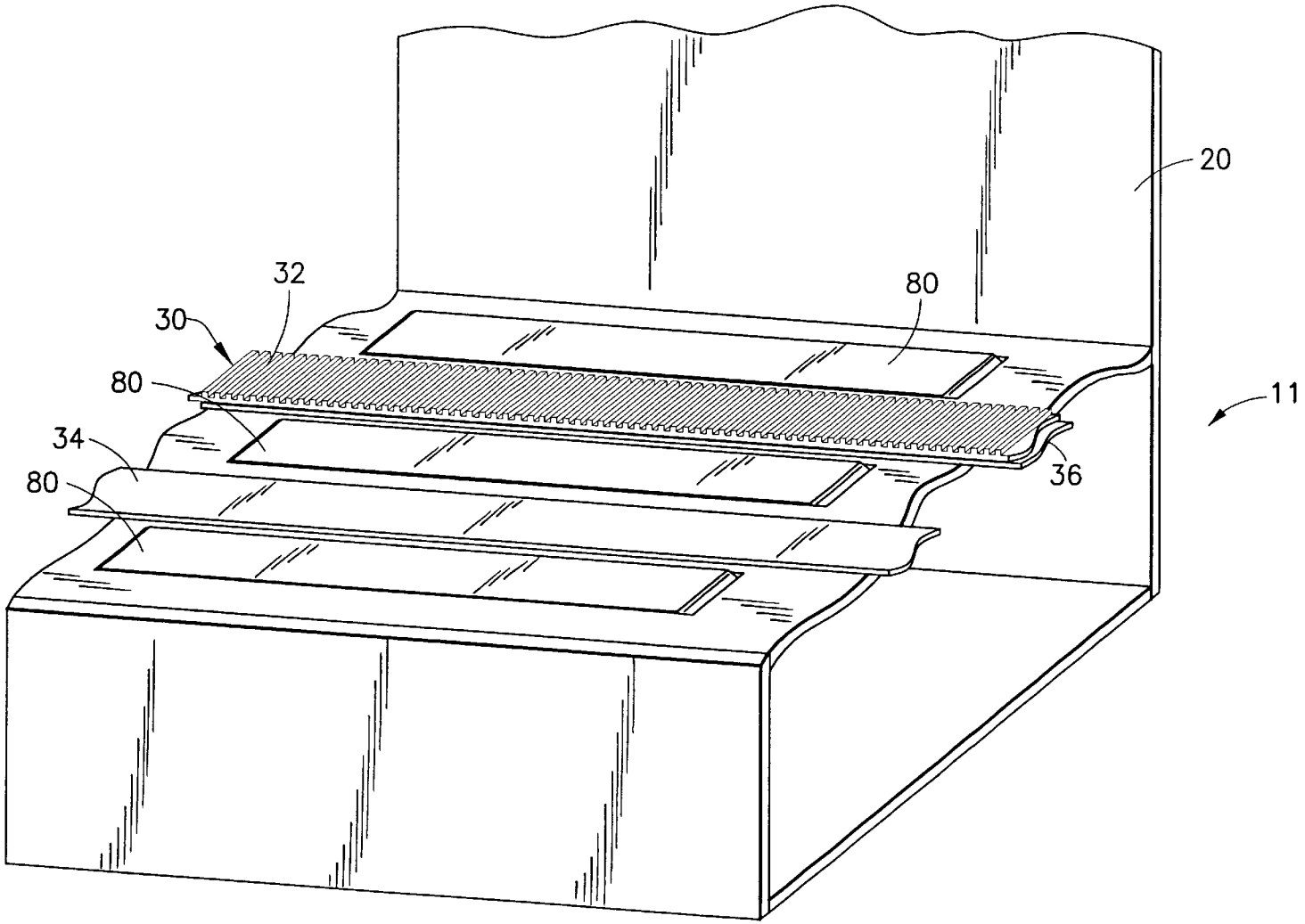
FIG. 5 is an isometric view of part of a stack advance, according to a further embodiment of the present invention, showing a plurality of jogger systems being mounted on the stack advance.
Figure 6:
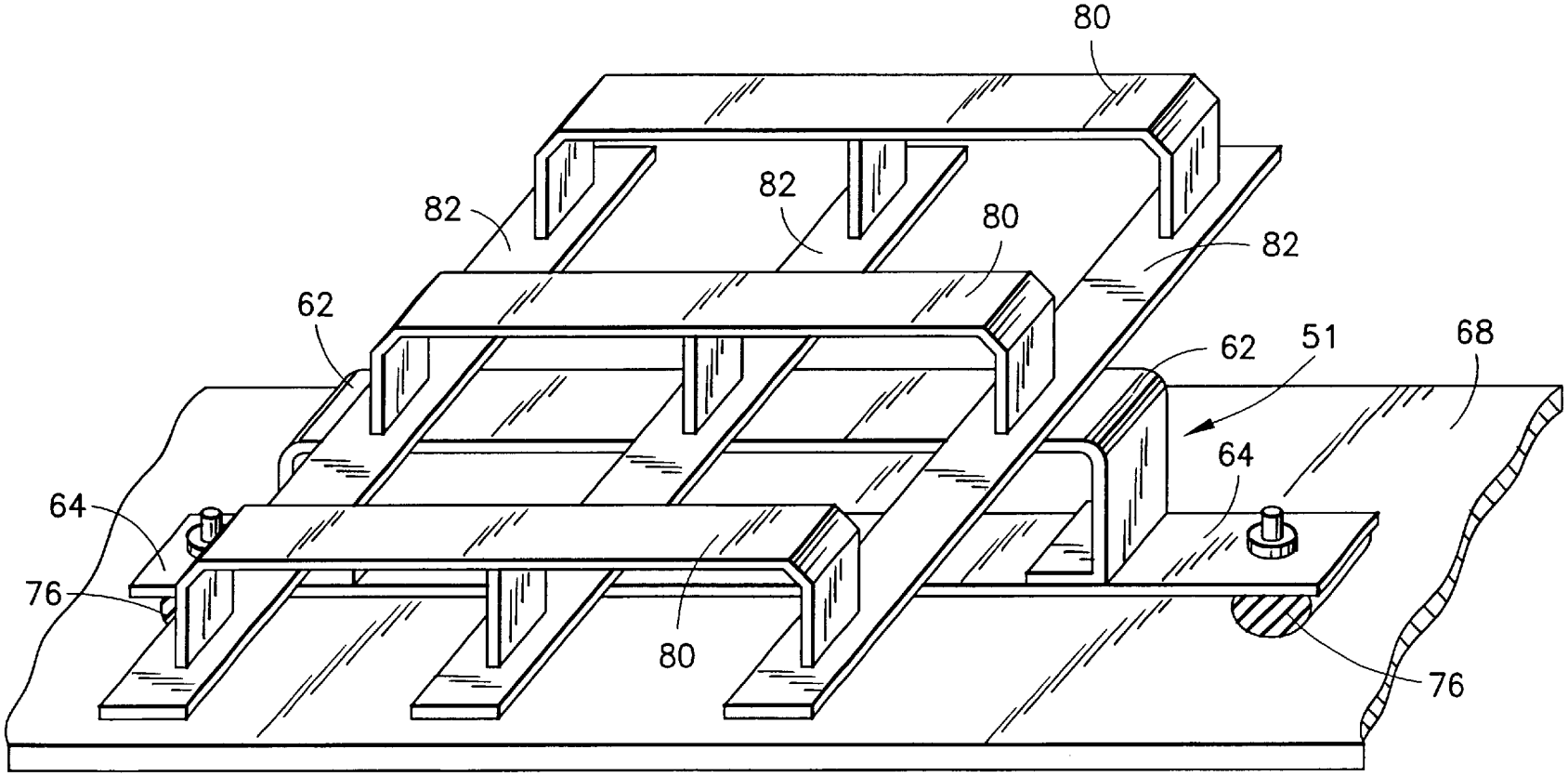
FIG. 6 is an isometric view of a mail stack pushing system showing a plurality of vibrating plates being connected to a jogger system.

Additionally, in an alternative embodiment of the present invention, one or more separate vibrating devices 80 could be used to vibrate the mailpieces as shown in FIG. 5. In FIG. 5, three vibrating devices 80 are mounted on the sides of the outboard slider bed 34 and the time belt 30 of a stack advance 11. However, it is possible to use only one or two vibrating devices 80 on the stack advance 11. Each of the vibrating devices 80 can be a jogger system 51 as shown in FIG. 4B, without being attached to a slider bed. Alternatively, each of the vibrating devices 80 can be a vibrating plate being connected together to a common frame 82 and caused to vibrate by a jogger system 51 as shown in FIG. 6.

Although the invention has been described with respect to a preferred version and embodiment thereof, it will be understood by those skilled in the art that the foregoing and various other changes, omissions and deviations in the form and detail thereof may be made without departing from the spirit and scope of this invention.

What is claimed is:

1. In a stack advance for transporting a mail stack consisting of a plurality of mailpieces, each mailpiece having a main edge and on the two sides thereof a first side edge and an opposing second side edge, wherein the stack advance has a deck to support the mailpieces on the main edges, and a registration wall substantially perpendicular to the deck for aligning the first side edge of the mailpieces, a method of improving mailpiece registration on the stack advance comprising the steps of:

1) moving the mailpieces in a downstream direction substantially parallel with the registration wall and the deck;

2) intermittently pushing at least a portion of the mail stack adjacent to the second side edge of the mailpieces in a direction to urge the main edge of the mailpieces to properly contact with the deck and to urge the first side edge to move toward the registration wall.

2. The method of claim 1, wherein the pushing causes a vibration of the mail stack, the vibration being substantially perpendicular to the deck.

3. The method of claim 1, wherein the pushing causes a vibration of the mail stack, the vibration having a first component substantially parallel to the deck and a second component substantially perpendicular to the deck.

4. The method of claim 1, wherein the registration wall is placed in a substantially vertical direction.

5. The method of claim 1, wherein the deck is oriented in a substantially horizontal direction and the mailpieces are vertically stacked such that the side edges of the mailpieces are oriented in a substantially vertical direction.

6. The method of claim 1, wherein said deck comprises a slider bed having a length substantially parallel to the registration wall and an upper surface for supporting the mail stack adjacent to the second side edge of the mailpieces, said slider bed being mounted on the deck for movement, said pushing in step 2 being caused by the movement of the upper surface of the slider bed.

7. The method of claim 6, wherein said slider bed comprises a lower surface opposing the upper surface, said slider bed further comprising:

at least one imbalance weight movably attached to the lower surface of the slider bed; and means for moving said at least one imbalance weight thereby causing the movement of the slider bed.

8. The method of claim 7, wherein said at least one imbalance weight is mounted on a shaft substantially parallel to the length of the slider bed, said method further comprising the step of rotating the imbalance weight about the shaft with the moving means.

9. An improved stack mail feeder for moving a mail stack consisting of a plurality of mailpieces, each mailpiece having a main edge and on the two sides of the main edge a first side edge and an opposing second side edge, said mail feeder comprising:

a deck for supporting the mail stack;

a registration wall for registering the mail stack by aligning the first side edge of the mailpieces;

means for transporting the mailpieces;

means for intermittently pushing the mail stack near the second side edge of the mailpieces.

10. The stack mail feeder of claim 9, wherein said pushing means causes a vibration of the mail stack in a direction substantially perpendicular to the deck.

11. The stack mail feeder of claim 9, wherein said pushing means causes a vibration of the mail stack, the vibration having a first component substantially parallel to the deck and a second component substantially perpendicular to the deck.

12. The stack mail feeder of claim 9, wherein said pushing means comprises:

a slider bed having a length substantially parallel to the registration wall and an upper surface substantially parallel to the deck for supporting the mail stack near the second side edge of the mailpieces; and means for moving the upper surface of the slider bed.

13. The stack mail feeder of claim 12, wherein said moving means comprises compliant means for mounting said slider bed to the stack mail feeder, said compliant means allowing the upper surface of the slider bed to move in a vibration mode.

14. An improved stack mail feeder for moving a mail stack consisting of a plurality of mailpieces, each mailpiece having a main edge and on the two sides of the main edge a first side edge and an opposing second side edge, said mail feeder comprising:

a deck for supporting the mail stack;

a registration wall for registering the mail stack by aligning the first side edge of the mailpieces;

means for transporting the mailpieces;

means for intermittently pushing the mail stack near the second side edge of the mailpieces, the means for intermittently pushing the mail stack comprising:

a slider bed having a length substantially parallel to the registration wall and an upper surface substantially parallel to the deck for supporting the mail stack near the second side edge of the mailpieces; and means for moving the upper surface of the slider bed;

wherein said moving means comprises compliant means for mounting said slider bed to the stack mail feeder, said compliant means allowing the upper surface of the slider bed to move in a vibration mode; and wherein said compliant means comprises at least one grommet.

15. The stack mail feeder of claim 13, wherein said moving means further comprises a baseplate for mounting the slider bed to the stack mail feeder, and compliant means for mounting the slider bed to the baseplate, said compliant means allowing the upper surface of the slider bed to move in a vibration mode.

16. The stack mail feeder of claim 15, wherein said moving means further comprises damping means placed between the baseplate and the stack mail feeder to isolate the vibration of the slider bed from the stack mail feeder.

17. The stack mail feeder of claim 12, wherein the slider bed further has a lower surface opposing the upper surface and said moving means further comprises at least one imbalance weight rotatably mounted on the lower surface, and means for rotating said at least one imbalance weight so as to cause a vibration of the upper surface of the slider bed.

18. The stack mail feeder of claim 12, wherein said moving means further comprises at least one arm bracket attached to the slider bed for pivotally mounting the slider bed to the stack mail feeder, causing a vibration of the slider bed, wherein the vibration has a first component substantially parallel to the deck and a second component substantially perpendicular to the deck.

19. The stack mail feeder of claim 9, wherein said pushing means comprises a plurality of joggers, each jogger comprising:

a slider bed having a length substantially parallel to the registration wall and an upper surface substantially parallel to the deck for supporting the mail stack near the second side edge of the mailpieces; and means for moving the upper surface of the slider bed.

* * * * *